US010080700B1

(12) United States Patent
Bagheri

(10) Patent No.: US 10,080,700 B1
(45) Date of Patent: Sep. 25, 2018

(54) WALKER HARNESS

(71) Applicant: Kourosh Bagheri, Shell Beach, CA (US)

(72) Inventor: Kourosh Bagheri, Shell Beach, CA (US)

( * ) Notice: Subject to any disclaimer, the term of this patent is extended or adjusted under 35 U.S.C. 154(b) by 0 days.

(21) Appl. No.: 15/712,129

(22) Filed: Sep. 21, 2017

Related U.S. Application Data

(63) Continuation-in-part of application No. 15/218,052, filed on Jul. 24, 2016, now abandoned, which is a continuation of application No. 15/013,000, filed on Feb. 2, 2016, now Pat. No. 9,414,987, which is a continuation-in-part of application No. 14/617,872, filed on Feb. 9, 2015, now abandoned, which is a continuation of application No. 13/839,848, filed on Mar. 15, 2013, now Pat. No. 8,967,642.

(51) Int. Cl.
*A61H 3/00* (2006.01)
*A61H 3/04* (2006.01)
*A61G 5/10* (2006.01)

(52) U.S. Cl.
CPC ..... *A61H 3/04* (2013.01); *A61H 3/008* (2013.01); *A61G 5/1059* (2013.01); *A61H 2201/0161* (2013.01); *A61H 2201/5023* (2013.01)

(58) Field of Classification Search
None
See application file for complete search history.

(56) References Cited

U.S. PATENT DOCUMENTS 2,719,568 A * 10/1955 Webb ..... A61H 3/008 2/69
3,778,052 A * 12/1973 Andow ..... A61H 3/008 135/67
4,911,426 A * 3/1990 Scales ..... A61H 3/008 128/845
5,397,171 A * 3/1995 Leach ..... A61F 5/3784 128/875
5,530,975 A * 7/1996 Firebaugh ..... A61G 7/1017 5/81.1 T
6,436,011 B1 * 8/2002 Cook ..... A63B 69/0064 119/770
6,752,776 B2 * 6/2004 West ..... A61H 3/008 602/32
6,892,403 B2 * 5/2005 Liljedahl ..... A61G 7/1051 5/89.1

(Continued)

*Primary Examiner* — Noah Chandler Hawk
(74) *Attorney, Agent, or Firm* — QuickPatents, LLC; Kevin Prince

(57) ABSTRACT

A harness for lifting a person in conjunction with a walker apparatus includes a seat portion made with flexible webbing. Two flexible, adjustable back straps are each fixed with a rear edge of the seat portion proximate one of two opposing lateral edges. Two flexible, adjustable front straps are each fixed with a front edge of the seat portion proximate one of the lateral edges. The back straps and front straps each include a connection mechanism for fixing with the walker apparatus. As such, with the harness under the person either in a prone position or a seated position, the back straps extend up the person's back and around his shoulders such that the back straps may be pulled forward and the walker apparatus raised so as to lift the person from the prone position into the seated position, or from the seated position into a standing position.

20 Claims, 5 Drawing Sheets

(56) References Cited

U.S. PATENT DOCUMENTS

| | | | | |
|---|---|---|---|---|
| 7,341,025 | B1 * | 3/2008 | Streeter | A47D 13/046 119/770 |
| 8,967,642 | B2 | 3/2015 | Bagheri | |
| 9,414,987 | B2 | 8/2016 | Bagheri | |
| 2015/0150748 | A1 | 6/2015 | Bagheri | |
| 2017/0079879 | A1 * | 3/2017 | Fraser | B60N 2/90 |

* cited by examiner

WALKER HARNESS

CROSS-REFERENCE TO RELATED APPLICATIONS

This application is a Continuation-in-Part of U.S. patent application Ser. No. 15/218,052, filed on Jul. 24, 2016, which is a continuation of U.S. application Ser. No. 15/013,000 filed Feb. 2, 2016, entitled, WALKER, now U.S. Pat. No. 9,414,987, which is a continuation-in-part of U.S. application Ser. No. 14/617,872 filed Feb. 9, 2015, entitled WALKER, which is a continuation of U.S. application Ser. No. 13/839,848 filed Mar. 15, 2013, entitled WALKER, now U.S. Pat. No. 8,967,642, all of which are incorporated in their entirety herein by reference.

STATEMENT REGARDING FEDERALLY SPONSORED RESEARCH AND DEVELOPMENT

Not Applicable.

FIELD OF THE INVENTION

This invention relates to walking and sitting aids, and more particularly to a harness for use in conjunction with a walker apparatus for lifting a person from a prone or seated position to a seated or standing position.

DISCUSSION OF RELATED ART

Adult walkers and wheelchairs are known in the art which assist the mobility of persons, such as the elderly or disabled, who are unable to walk or move around without assistance. These devices have improved the range of activity of such persons under conditions where available assistance by personnel is limited. A person requiring mobility assistance may also be incontinent, dictating a device which both provides mobility and security while accommodating incontinence needs and providing for the comfort of the user.

Wheelchairs are one method of providing mobility, and the prior art includes wheelchair commodes for use by incontinent persons. However, since the wheelchair provides no exercise or movement for legs, these muscles will atrophy more quickly and ultimately diminish the physical strength of the patient.

Various types of adult walkers are commonly used by elderly or disabled persons who have the capability of supporting their weight on their legs and walking, but cannot do so unassisted because of a tendency to stumble or fall. For example, elderly persons who reside in long-term care facilities frequently have a great need to exercise and to convey themselves from one location to another, but are afraid to do so without the assistance of an aid.

A wide variety of adult walkers have been devised for elderly or disabled persons. Adult walkers typically consist of a rigid frame supported on the floor. Numerous frame variations are found in the art, including those of my previous patent applications that are incorporated herein above.

Some adult walkers have a seat or sling. This allows the walker to fully support the person in a seated position and may also be used to prevent falls. The support may be integral or removable. Some adult walkers have a strap or multiple straps to assist in securing the person and preventing falls. The prior art is inadequate, however, in providing a seat or sling harness that allows the person to be easily moved from a prone position to a seated position, or from a seated position to a standing position from a bed or a chair, or from either a sitting or prone position from the ground to a chair or bed.

Therefore, there is a need for a harness device that allows the person to be easily moved from a prone position to a seated position, or from a seated position to a standing position, in conjunction with a walker apparatus. Such a needed invention would be easy to use, durable and strong even with overweight patients, and would be comfortable to use. The present invention accomplishes these objectives.

SUMMARY OF THE INVENTION

The present device is a harness for lifting a person in conjunction with a walker apparatus. The harness comprises a seat portion made with flexible webbing having a top side, a bottom side, two opposing lateral edges, a front edge, and a rear edge. The seat portion is configured for receiving on the top side thereof the person's buttocks while his legs extend past the two opposing lateral edges.

Two flexible back straps each have a first end and a second end, and are each fixed with the rear edge of the seat portion proximate one of the lateral edges. The back straps each further include a rear connection mechanism configured for fixing with the walker apparatus.

Each back strap preferably includes a first length adjustment mechanism between the seat portion and the rear connection mechanism. Such a first length adjustment mechanism preferably is configured for selectively attaching the rear connection mechanism to the seat portion and for adjusting the length of the back strap therebetween. Each back strap preferably includes a connection section having a first length adjustment mechanism between the seat portion at a first end and the rear connection mechanism at a second end, and a back section adapted for extending up the person's back from a first end to a distal second end. The first end of the back section and the first end of the connection section are mutually attached at the seat portion. Each back strap may further include at the distal second end thereof a rear mounting strap having one of the connection mechanisms therealong.

In some embodiments a first back support strap extends between each back strap proximate the seat portion. In such an embodiment, the first back support strap is configured for supporting the person's back when in the seated position. The first back support strap may further include a third length adjustment mechanism, such as a conventional nylon strap length adjustment buckle.

A second back support strap preferably extends between each back strap and is configured for supporting the person's back when the person is in the seated position. Such a second back support strap may further include one of the third length adjustment mechanisms therealong.

Two flexible front straps are each fixed with the front edge of the seat portion proximate one of the lateral edges. The front straps each include a forward connection mechanism configured for fixing with the walker apparatus.

Each front strap preferably includes a second length adjustment mechanism between the seat portion and the forward connection mechanism. Such a second length adjustment mechanism preferably is configured for selectively attaching the front connection mechanism to the seat portion and for adjusting the length of the front strap therebetween.

At least one front support strap may be included to extend between each back strap. The front support strap is configured for maintaining a separation distance between the back straps forward the person when in the seated position. Each front support strap may further include one of the third length adjustment mechanism.

Similarly, at least one torso strap may be included to extend between each back strap around the front of the person for securing the person to the harness. Each torso strap may further include one of the third length adjustment mechanism.

As such, with the harness under the person either in a prone position or a seated position, the forward connection mechanism of each front strap is fixed with the walker apparatus, and the rear connection mechanism of each back strap is fixed with the walker apparatus. The back straps extend up the person's back and around his shoulders such that the back straps may be pulled forward and the walker apparatus raised so as to lift the person from the prone position into the seated position, or from the seated position into a standing position. Indeed, with a suitable walker apparatus the person may be lifted from a prone or seated position on a floor surface to a standing position.

Preferably the seat portion includes an elimination aperture configured to allow the person to go to the bathroom while suspended in the seated position over a toilet (not shown). Further, a seat cushion may be fixed with the top side of the seat portion, such that when the person is in the seated position or prone position, the person is supported by the seat cushion. Similarly, a seat back may be fixed between each back strap, such that when the person is in the seated position or prone position, the person's back is supported by the seat back. The seat back may be a cushion, or the like. Each strap is preferably made from a nylon webbing material, and each connection mechanism, is made from an injection molded material.

The present invention is a harness device that allows the person to be easily moved from a prone position to a seated position, or from a seated position to a standing position, in conjunction with a walker apparatus. The present invention is easy to use, durable and strong even with overweight patients, and is comfortable to use. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
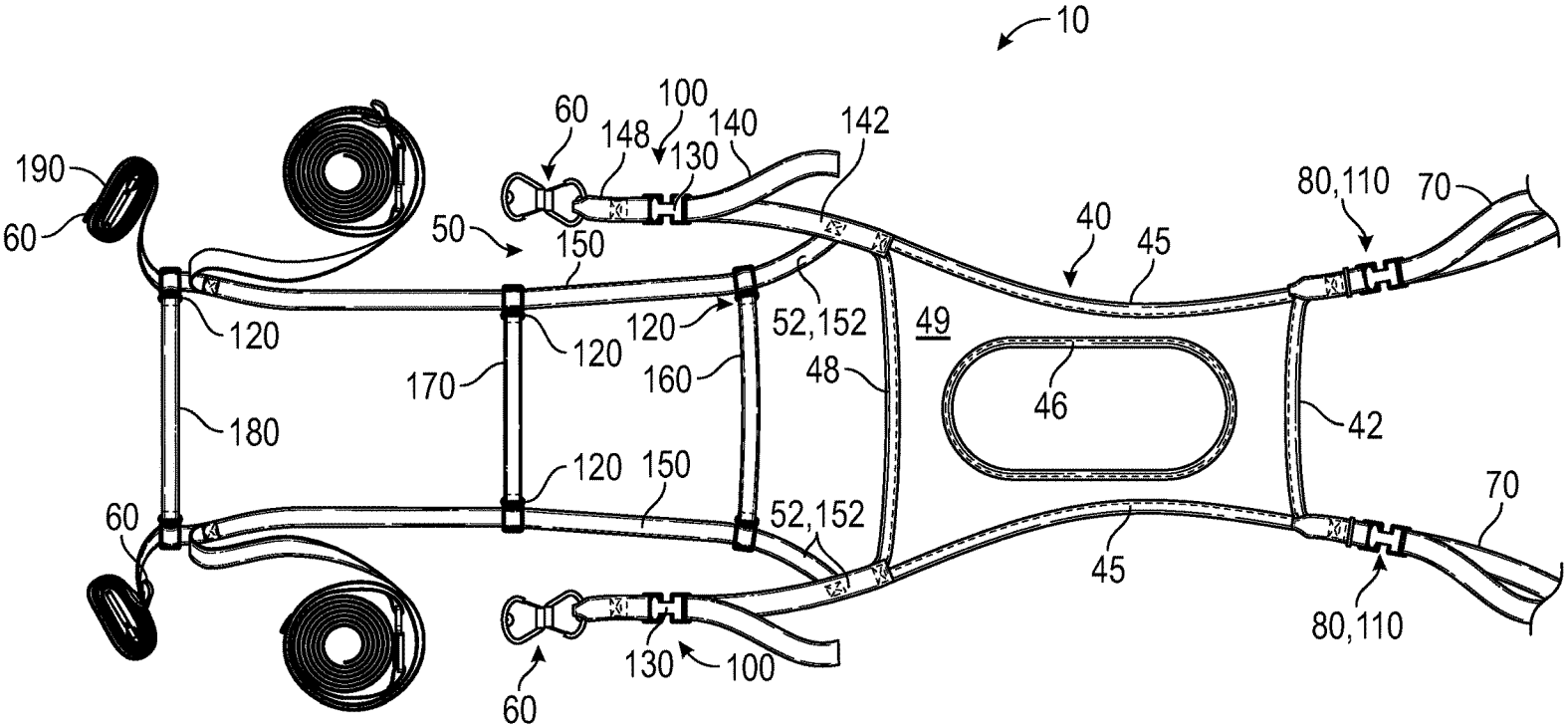
FIG. 1 is a top plan view of a harness of the invention.
Figure 2:
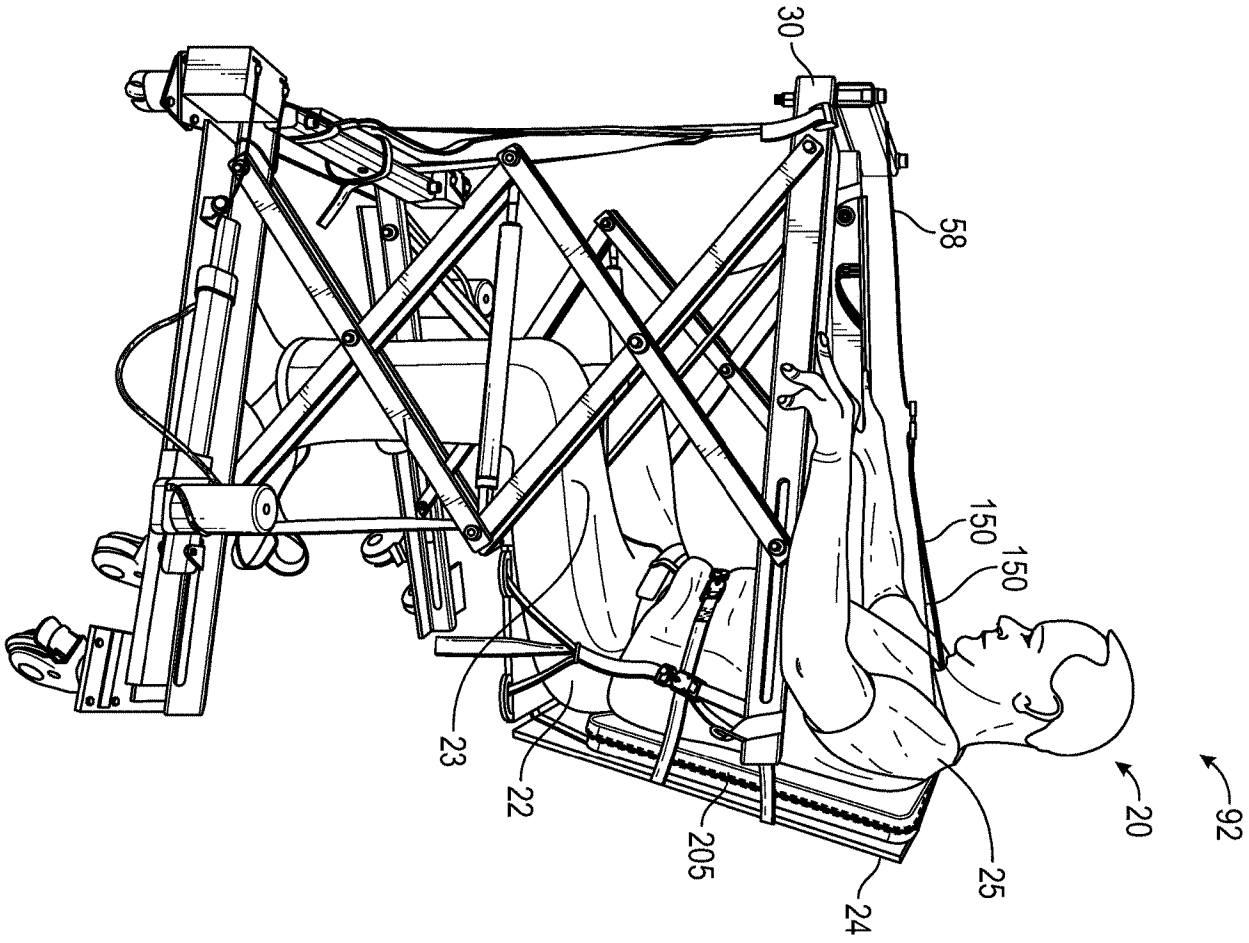
FIG. 2 is a perspective view of the harness of the invention being used to support a person in a seated position in conjunction with a walker apparatus.

FIGS. 1 and 2 illustrate a harness 10 for lifting a person 20 in conjunction with a walker apparatus 30. Such a walker apparatus 30 is preferably of the type having a rigid U-shaped frame with a motorized lift and a base with wheels, or the like.

The harness 10 comprises a seat portion 40 made with flexible webbing having a top side 49, a bottom side 41, two opposing lateral edges 45, a front edge 42, and a rear edge 48. The seat portion 40 is configured for receiving on the top side 49 thereof the person's buttons 22 while his legs 23 extend past the two opposing lateral edges 45.

A pair of flexible back straps 50 each have a first end 52 and a second end 5, and are each fixed with the rear edge 48 of the seat portion 40 proximate one of the lateral edges 45. The back straps 50 each further include a rear connection mechanism 60, such as a rigid metal hook, carabiner or the like, configured for fixing with the walker apparatus 30 at a metal ring connection point 35 or around the frame of the walker apparatus 30.

Each back strap 50 preferably includes a first length adjustment mechanism 100 between the seat portion 40 and the rear connection mechanism 60. Such a first length adjustment mechanism 100 may be a mechanical buckle, such those made by the German company Fidlock GmbH and sold under the name trade name V-buckle, for example. Such a first length adjustment mechanism 100 preferably is configured for selectively attaching the rear connection mechanism 60 to the seat portion 40 and for adjusting the length of the back strap 50 therebetween.

Each back strap 50 preferably includes a connection section 140 having a first length adjustment mechanism between the seat portion 40 at a first end 142 and the rear connection mechanism 60 at a second end 148, and a back section 150 adapted for extending up the person's back 24 from a first end 152 to a distal second end 158. The first end 152 of the back section 150 and the first end 142 of the connection section 140 are mutually attached at the seat portion 140. Each back strap 50 may further include at the distal second end 58 thereof a rear mounting strap 190 having one of the connection mechanisms 60,80 therealong.

In some embodiments a first back support strap 160 extends between each back strap 50 proximate the seat portion 40. In such an embodiment, the first back support strap 160 is configured for supporting the person's back 24 when in the seated position 92. The first back support strap 160 may further include a third length adjustment mechanism 120, such as a conventional nylon strap length adjustment buckle.

A second back support strap 170 preferably extends between each back strap 50 and is configured for supporting the person's back 24 when the person 20 is in the seated position 92. Such a second back support strap 170 may further include one of the third length adjustment mechanisms 120 therealong.

A pair of flexible front straps 70 are each fixed with the front edge 42 of the seat portion 40 proximate one of the lateral edges 45. The front straps 70 each include a forward connection mechanism 80, such as a rigid metal hook, carabiner or the like, configured for fixing with the walker apparatus 30 at a metal ring connection point (not shown) or around the frame of the walker apparatus 30.

Each front strap 70 preferably includes a second length adjustment mechanism 110 between the seat portion 40 and the forward connection mechanism 80. Such a second length adjustment mechanism 110 may be a mechanical buckle, such those made by the German company Fidlock GmbH and sold under the name trade name V-buckle, for example. Such a second length adjustment mechanism 110 preferably is configured for selectively attaching the front connection mechanism 70 to the seat portion 40 and for adjusting the length of the front strap 70 therebetween.

Figure 3:
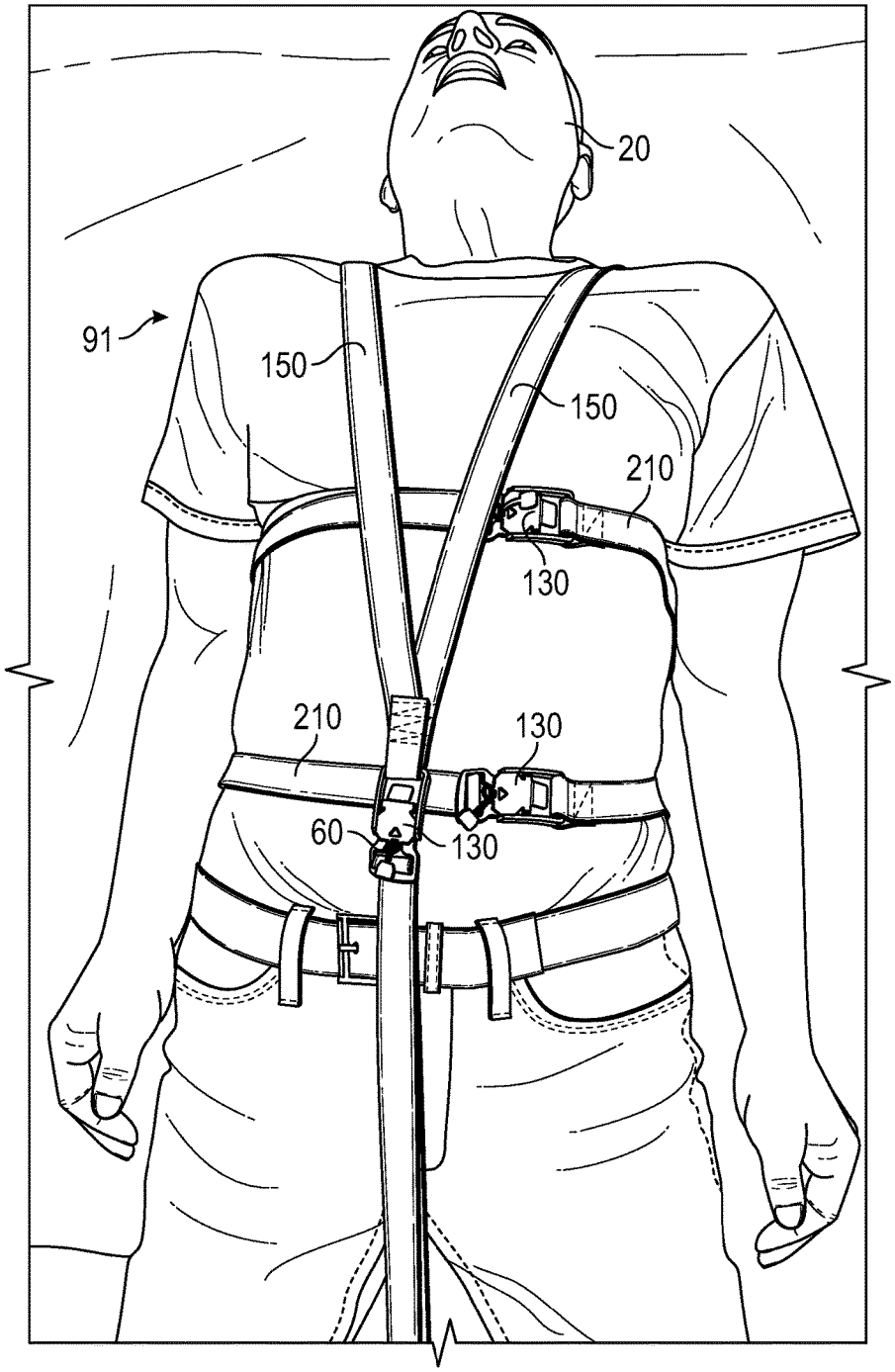
FIG. 3 is a top perspective view of a person in a prone position strapped onto the harness of the present invention.

At least one front support strap 180 may be included to extend between each back strap 50. The front support strap 180 is configured for maintaining a separation distance between the back straps 50 forward the person when in the seated position 92. Each front support strap 180 may further include one of the third length adjustment mechanism 120. Similarly, at least one torso strap 210 (FIG. 3) may be included to extend between each back strap 50 around the front of the person 20 for securing the person 20 to the harness 10. Each torso strap 210 may further include one of the third length adjustment mechanism 120.

Figure 4:
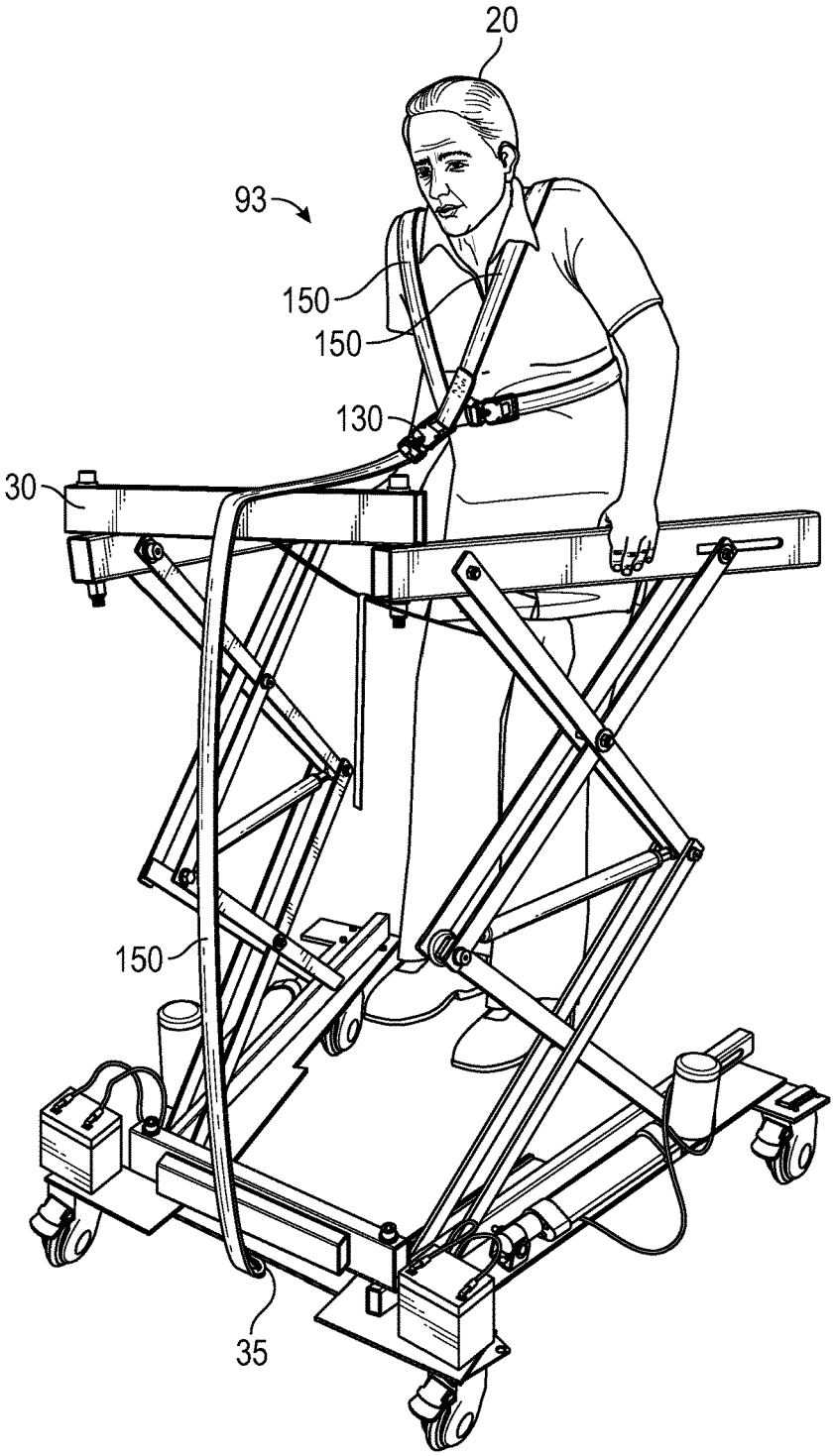
FIG. 4 is a perspective view of the person lifted into a standing position with the harness in conjunction with the walker apparatus.

As such, with the harness 10 under the person 20 either in a prone position 91 (FIG. 3), or a seated position 92 (FIG. 2), the forward connection mechanism 80 of each front strap 70 is fixed with the walker apparatus 30, and the rear connection mechanism 60 of each back strap 50 is fixed with the walker apparatus. The back straps 50 extend up the person's back 24 and around his shoulders 25 such that the back straps 50 may be pulled forward and the walker apparatus raised so as to lift the person 20 from the prone position 91 into the seated position 92, or from the seated position 92 into a standing position 93 (FIG. 4).

Preferably the seat portion 40 includes an elimination aperture 46 configured to allow the person 20 to go to the bathroom while suspended in the seated position 92 over a toilet (not shown). Further, a seat cushion 200 may be fixed with the top side 49 of the seat portion 40, such that when the person 20 is in the seated position 92 or prone position 91, the person 20 is supported by the seat cushion 200. Similarly, a seat back 205 may be fixed between each back strap 50, such that when the person 20 is in the seated position 92 or prone position 91, the person's back 24 is supported by the seat back 205. The seat back 205 may be a cushion, or the like.

Each strap is preferably made from a nylon webbing material, and each connection mechanism 60,80 is made from an injection molded material. Each connection mechanism 60, 80 is preferably made with a rigid metal material. Each length adjustment mechanism 100,110,120 is preferably made with a rigid metal or plastic material.

Figure 5:
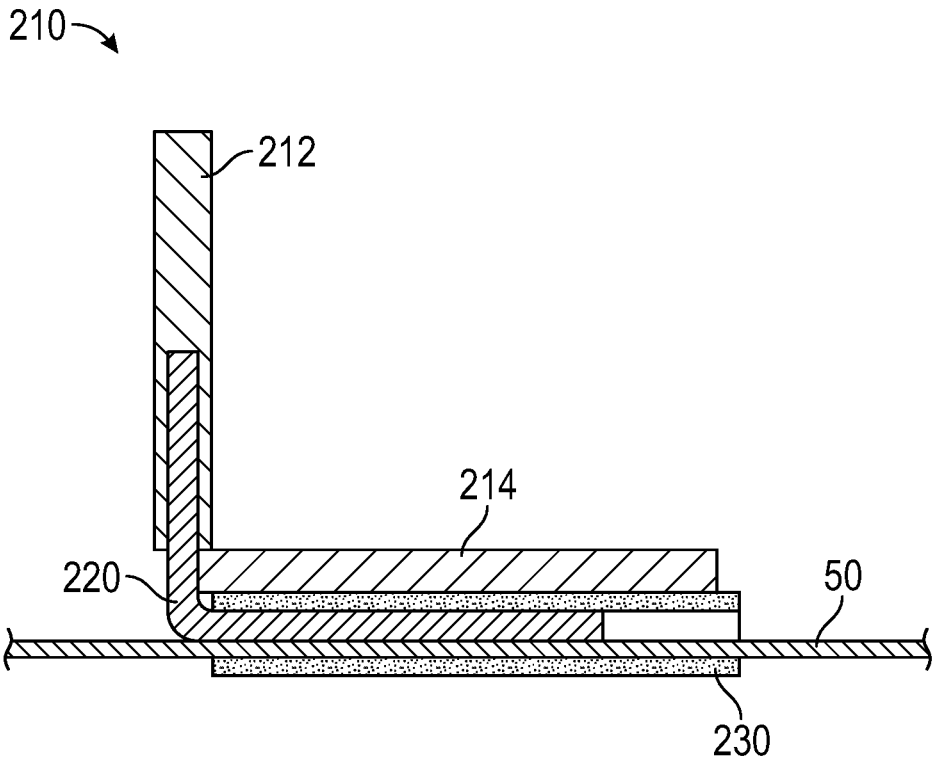
FIG. 5 is a cross-sectional view of an embodiment having a cushioned seat and cushioned sleeves around the back straps.

In one embodiment, each back strap 50 includes a resilient sleeve 230 (FIG. 5) therearound that includes a cushioning surface. In such an embodiment, a cushioned seat 210 having a back portion 212 and a bottom portion 214 may be included. Preferably the seat 210 further including a pair of hooks 220 projecting away from the bottom portion 214 of the chair, each hook 220 being adapted for insertion between one of the resilient sleeves 230 and the back strap 50 for securing the seat 210 to the harness 10. As such, the seat 210 may be used for prolonged sitting in the harness 10.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A harness for lifting a person in conjunction with a walker apparatus, the harness comprising:

a seat portion comprising flexible webbing having a top side, a bottom side, two opposing lateral edges, a front edge, and a rear edge, the seat portion configured for receiving on the top side thereof the person's buttocks while his legs extend past the two opposing lateral edges;

a pair of flexible back straps fixed with the rear edge each proximate one of the lateral edges, the back straps each including a rear connection mechanism configured for fixing with the walker apparatus;

a pair of flexible front straps fixed with the front edge each proximate one of the lateral edges, the front straps each include a forward connection mechanism configured for fixing with the walker apparatus;

whereby with the harness under the person either in a prone or seated position, the forward connection mechanism of each front strap is fixed with the walker apparatus, and the rear connection mechanism of each back strap is fixed with the walker apparatus, the back straps extending up the person's back and around his shoulders such that the back straps may be pulled forward and the walker apparatus raised so as to lift the person from the prone position into the seated position, or from the seated position into a standing position.

2. The harness of claim 1 wherein the seat portion includes an elimination aperture configured for allowing the person to go to the bathroom while suspended in the seated position over a toilet.

3. The harness of claim 1 wherein each back strap includes a first length adjustment mechanism between the seat portion and the rear connection mechanism.

4. The harness of claim 3 wherein each first length adjustment mechanism is configured for selectively attaching the rear connection mechanism to the seat portion and for adjusting the length of the back strap therebetween.

5. The harness of claim 1 wherein each front strap includes a second length adjustment mechanism between the seat portion and the forward connection mechanism.

6. The harness of claim 5 wherein each second length adjustment mechanism is configured for selectively attaching the forward connection mechanism to the seat portion and for adjusting the length of the front strap therebetween.

7. The harness of claim 1 wherein each back strap includes a connection section having a first length adjustment mechanism between the seat portion at a first end and the rear connection mechanism at a second end, and a back section adapted for extending up the person's back from a first end to a distal second end, the first end of the back section and the first end of the connection section being mutually attached at the seat portion.

8. The harness of claim 7 wherein each first length adjustment mechanism is configured for selectively attaching the rear connection mechanism to the seat portion and for adjusting the length of the connection section of the back strap therebetween.

9. The harness of claim 7 wherein each back strap further includes at the distal second end thereof a rear mounting strap having one of the connection mechanisms configured for connecting with the walker apparatus.

10. The harness of claim 9 wherein each rear mounting strap further includes one of the first length adjustment mechanisms therealong.

11. The harness of claim 1 further including a first back support strap extending between each back strap proximate the seat portion.

12. The harness of claim 11 wherein the first back support strap further includes a third length adjustment mechanism therealong.

13. The harness of claim 12 further including a second back support strap extending between each back strap, the second back support strap configured for supporting a person's back when in the seated position.

14. The harness of claim 13 wherein the second support strap further includes another third length adjustment mechanism therealong.

15. The harness of claim 1 further including a front support strap extending between each back strap, the front support strap configured for maintaining a separation distance between the back straps forward of the person when in the seated position.

16. The harness of claim 15 wherein the front support strap further includes one of the third length adjustment mechanisms therealong.

17. The harness of claim 1 wherein a seat cushion is fixed with the seat portion, whereby when the person is in the seated or prone position, the person is supported by the seat cushion.

18. The harness of claim 17 wherein a seat back is fixed between the back straps, whereby when the person is in the seated or prone position, the person's back is supported by the seat back.

19. The harness of claim 1 wherein each back strap includes a resilient sleeve therearound, each resilient sleeve including a cushioning surface thereon.

20. The harness of claim 19 further including a cushioned seat having a back portion and a bottom portion, the seat further including a pair of hooks projecting away from the bottom portion of the seat, each hook adapted for insertion between one of the resilient sleeves and the back strap for securing the seat to the harness.

* * * * *